US006110262A

United States Patent [19]

Kircher et al.

[11] Patent Number: 6,110,262

[45] Date of Patent: Aug. 29, 2000

[54] SLURRY COMPOSITIONS FOR DIFFUSION COATINGS

[75] Inventors: Thomas Kircher, Douglassville; Bruce G. McMordie, Perkasie, both of Pa.; Srinivasan Shankar, Branford, Conn.

[73] Assignee: Sermatech International, Inc., Limerick, Pa.

[21] Appl. No.: 09/143,962

[22] Filed: Aug. 31, 1998

[51] Int. Cl.[7] ..... C23C 10/26

[52] U.S. Cl. ..... 106/14.44; 106/14.21; 106/14.41; 106/14.42; 106/403; 106/404; 420/428; 420/528; 148/248; 148/264

[58] Field of Search ..... 106/14.44, 14.21, 106/14.41, 14.42, 403, 404; 420/428, 528; 148/248, 264

[56] References Cited

U.S. PATENT DOCUMENTS

| | | | |
|---|---|---|---|
| 3,257,230 | 6/1966 | Wachtell et al. | 117/107.2 |
| 3,544,348 | 12/1970 | Boone et al. | 117/2 |
| 3,883,944 | 5/1975 | Davis et al. | 29/460 |
| 3,903,338 | 9/1975 | Cook et al. | 427/444 |
| 4,004,047 | 1/1977 | Grisik | 427/142 |
| 4,241,113 | 12/1980 | Martinengo et al. | 427/229 |
| 4,293,338 | 10/1981 | Rose et al. | 75/253 |
| 4,835,011 | 5/1989 | Olson et al. | 427/253 |
| 5,217,757 | 6/1993 | Milaniak et al. | 427/253 |
| 5,366,765 | 11/1994 | Milaniak et al. | 427/229 |
| 5,658,614 | 8/1997 | Basta et al. | 427/253 |
| 5,795,659 | 8/1998 | Meelu et al. | 428/610 |

FOREIGN PATENT DOCUMENTS 0 837 153 A2 4/1998 European Pat. Off. .

OTHER PUBLICATIONS

Database WPI, Section CH. Week 198025, Derwent Publications Ltd., London, GB Class A32, AN 1980–44120C and JP 55 062158 (Kawasaki Heavy Ind. Ltd), May 10, 1980 (Abstract).

B.G. McMordie and A.K. Isaacs, "Slurry Aluminide Coating Processes for Gas Turbine Components at Overhaul," paper presented at The Annual Gas Turbine Conference and Exhibition, Harrogate, United Kingdom, Nov. 1, 1991.

"PWA 545: Cobalt–Aluminum Slurry", P&W Specification, United Technologies Pratt & Whitney, Mar. 30, 1989.

"PWA 830: Surface Treatments—Application of Protective Coatings", Pratt & Whitney Specification, May 15, 1996.

*Primary Examiner*—Anthony Green

*Attorney, Agent, or Firm*—Seidel, Gonda, Lavorgna & Monaco, PC

[57] ABSTRACT

Slurry coating compositions are provided for metal substrates, particularly nickel or cobalt-containing alloys, that enable inward-type diffusion aluminide coatings having a substantially uniform coating thickness to be formed thereon. Substantially uniform coating thicknesses are achieved independent of applied slurry composition thickness or application method. The slurry coating composition of the invention comprises a Cr—Al alloy containing about 50 wt % to about 80 wt % Cr in the alloy, LiF in an amount greater than or equal to 0.3 wt % of the Cr—Al alloy, an organic binder, and a solvent.

7 Claims, 2 Drawing Sheets

SLURRY COMPOSITIONS FOR DIFFUSION COATINGS

FIELD OF THE INVENTION

The present invention relates generally to the field of corrosion protection for metal substrates, and more specifically to diffusion coatings for nickel-based or cobalt-based alloy substrates.

BACKGROUND OF THE INVENTION

In a modern gas turbine engine, components such as blades, vanes, combustor cases and the like are usually made from nickel and cobalt alloys. Nickel and cobalt-based superalloys are most often used to fabricate gas turbine parts because of the high strength required for long periods of service at the high temperatures characteristic of turbine operation. These components are usually located in the "hot section" of the turbine. As such, there are special design requirements imposed upon these components due to the rigorous environment in which they operate. Turbine blades and vanes are often cast with complex hollow core passages for transporting internal cooling air. Also, the wall thickness of gas turbine hot section parts is carefully controlled to balance the need for high temperature strength with the need to minimize the weight of the component part.

The surfaces of turbine engine parts are exposed to the hot gases from the turbine combustion process. Oxidation and corrosion reactions at the surface of the component parts can cause metal wastage and loss of wall thickness. The loss of metal rapidly increases the stresses on the respective component part and can result in part failure. Protective coatings are thus applied to these component parts to protect them from degradation by oxidation and corrosion.

Diffusion aluminide coatings are a standard method for protecting the surfaces of nickel- and cobalt-alloy gas turbine hardware from oxidation and corrosion. Aluminide coatings are based on intermetallic compounds formed when nickel and cobalt react with aluminum at the substrate's surface. An intermetallic compound is an intermediate phase in a binary metallic system, having a characteristic crystal structure enabled by a specific elemental (atomic) ratio between the binary constituents. For example, a number of such phases form in the nickel-aluminum binary system, including $Ni_2Al_3$, NiAl, or $NiAl_3$. Many aluminum-based intermetallic compounds (i.e., aluminides) are resistant to high temperature degradation and therefore are preferred as protective coatings, but such coatings are more brittle than the superalloy substrates underlying the coatings. An example of one particularly useful intermetallic compound formed in nickel-based systems is NiAl.

Careful dimensional tolerances imposed on parts during manufacture must be maintained during the coating process. Uneven or excessively thick diffusion coating layers can effectively act to reduce wall thickness and hence the part's strength. Furthermore, excessively thick aluminide coatings, especially at leading and trailing edges of turbine blades where high stresses mostly occur, can result in fatigue cracking.

One method for applying a diffusion aluminide coating is via a liquid phase slurry aluminization process. Typical slurries incorporate a mixture of aluminum and/or silicon metal powders (pigments) or alloys o those elements in an inorganic binder. The slurries are directly applied to a substrate surface. Formation of the diffused aluminide is accomplished by heating the part in a non-oxidizing atmosphere or vacuum at temperatures between 1600–2000° F. for two to twenty hours. The heating melts the metal in the slurry and permits the reaction and diffusion of the aluminum and/or silicon pigments into the substrate surface. Coatings of this type have been described in U.S. Pat. No. 5,795,659.

In liquid-phase slurry aluminization, the slurry must be applied directly to the part in a controlled amount because the resulting thickness of the diffused coating is directly proportional to the amount of the slurry applied to the surface. Because of this proportional relationship between applied slurry amount and final diffused coating thickness, it is critical in this method to carefully control the application of the slurry material. The necessarily controlled application requires a great deal of operator skill and quality assurance, particularly for parts having complicated geometries such as turbine blades. This places a limit on the quantity of parts that can be coated in an economical, timely fashion.

A more common industrial method for producing aluminide coatings is by the "pack cementation" method. Pack cementation processes have been described, for example, in U.S. Pat. Nos. 3,257,230 and 3,544,348. The basic pack method requires a powder mixture including (a) a metallic source of aluminum, (b) a vaporizable halide activator, usually a metal halide, and (c) an inert filler material such as a metal oxide (i.e., $Al_2O_3$).

Parts to be coated with such a mixture are first entirely encased in the pack material and then enclosed in a sealed chamber or "retort". The retort is purged using an inert or reducing gas and heated to a temperature between 1400–2000° F. Under these conditions, the halide activator dissociates, reacts with aluminum from the metallic source, and produces gaseous aluminum halide species. These species migrate to the substrate's surface where the aluminum-rich vapors are reduced by the nickel or cobalt alloy surface to form intermetallic coating compositions.

The amount of aluminum-rich vapors available at the surface of the part is defined by the "activity" of the process. The activity of a process is controlled in general by the amount and type of halide activator, the amount and type of aluminum source alloy, the amount of inert oxide diluent, and the temperature of the process. In some cases other metallic powders such as chromium or nickel are added to influence or "moderate" the aluminum activity in a pack.

The activity of the process influences the structure of the aluminide coating formed. "Low activity" processes produce "outwardly" diffused coatings where the coating forms predominately by the outward migration of nickel from the substrate and its subsequent reaction with aluminum at the part surface. "High activity" processes produce "inwardly" diffused coatings where the coating forms predominately by migration of aluminum into the surface of the substrate.

FIG. 1 shows an outwardly diffused coating structure produced by a low activity process. The original surface of the substrate is labeled. A limitation of outwardly diffused aluminide coatings is that oxides or contaminants present at the original surface of the part can become entrapped within the interior of the final diffused coating structure. If these oxides or contaminants are present in a somewhat continuous manner along the original substrate surface, the effectiveness of the low activity, outwardly diffused coatings is diminished under the stressful operating conditions of the turbine engine.

FIG. 2 shows an example of a higher activity, inwardly-diffused coating structure. The original surface of the substrate is labeled. The aluminum content in the outer zone is sufficient to cause precipitation of elements normally dissolved within the original superalloy substrate. Because of the inward diffusion of aluminum which predominates the coating formation process, oxides and contaminants present at the original substrate surface remain in the outer-most region of the final diffused coating structure where they are less likely to comprise the coating performance.

The pack process generally produces reliably uniform diffused aluminide surface layers on complex shapes such as those characteristic of gas turbine components. However, one major limitation of the pack cementation method is the generation of large amounts of hazardous waste. Considerably more raw material is required in a pack process than a slurry aluminization process. Although the pack mixtures can be "rejuvenated" to some extent with incremental additions of fresh powder, eventually the pack mixture must be replaced and the spent powder disposed in hazardous waste landfills. Dusts from the powder mixture also pose a health risk to employees handling the mixture.

In pack aluminization, the size of the retort, the geometry of the substrate to be coated, and the activity of aluminum in the powder mixture dictate the "ideal" batch size that should be employed to maximize the coating quality. The balance between these factors must be maintained to assure good coating quality, so it becomes difficult to coat batches quickly and cost effectively that are either smaller or larger than the ideal size. Moreover, the speed of the pack process is always slowed by the fact that a retort and a large mass of powder must be heated along with the parts contained therein.

The pack method also limits the speed and cost efficiency of coating production processes because it is essentially a batch process. In a batch process, each operation is completed on every individual part in a group before the next operation commences on any of the parts. In contrast, "one-piece flow" manufacturing is a continuous process which has been shown to be a quick, cost efficient means of production. In continuous coating processes, for example, there is continuous addition to, and withdrawal of, uncoated parts and coated parts from the production system. In "one-piece-flow" processes, an individual component flows directly to a second operation as soon as a first operation is completed, and as another component begins the first operation. Equipment and materials can be grouped so that the flow is balanced to accommodate the different time each operation requires. By non-limiting example only, "one-piece-flow" manufacturing has been widely associated with how the Toyota Corporation (Japan) manufactures automobiles. It is very difficult, and not necessarily economical, to adapt an inherently batch process, like pack aluminizing, to a continuous, one-piece flow manufacture. U.S. Pat. No. 3,903,338 discloses one such attempt.

Improvements in pack aluminide coating processes have also been made by removing the article to be coated from the immediate proximity of the aluminizing powder mixture. U.S. Pat. Nos. 4,132,816 and 4,501,776, for example, describe such aluminizing methods called "above the pack" or "vapor-phase" aluminization processes.

Although a vapor-phase aluminization method is somewhat "cleaner" in that less volume of powder is required, the process is limited to smaller retort volumes, and hence smaller batches of parts can be coated due to the nature of the vapor-phase process. If too large a retort is used, variations in the concentration of vapor-phase reactants occur in regions of the retort, resulting in variations in coating thickness among the parts in the retort. The resultant smaller batch sizes of the vapor-phase method limit production throughput and increase coated part costs.

Vapor-phase aluminization processes tend to operate generally at higher temperatures and lower aluminum activities than pack processes. One consequence of this shift in thermodynamic conditions is a shift in coating structure and composition from a primarily inward, "high activity" growth mechanism (indicative of the pack process) to a primarily outward, "low activity" growth mechanism.

There are other limitations of pack and vapor-phase coating processes. Most gas turbine components have "no coat" areas which must be protected from aluminization during the coating process. For example, most turbine blade root attachments (commonly referred to as "fir trees") must not be coated due to the high fatigue stresses they experience during engine operation. In order to prevent aluminizing vapors from reaching these surfaces during the coating process, one of several masking techniques are usually used.

One method of masking is to apply a layer of metal-rich paste over the "no-coat" regions. The metal-rich layer acts as a "sponge" to absorb the aluminizing vapors. An example of such a metal-rich masking compound is the material "M-7" from Alloy Surfaces (Wilmington, Del.). While the metal-rich paste is effective for the most part in blocking the aluminizing process, it can react with and sinter to the superalloy substrate during the coating process.

For this reason, an intermediate layer of a ceramic-rich paste is usually applied to the part surface prior to application of the metal-rich paste. An example of such a ceramic-rich masking compound is the material "M-1" from Alloy Surfaces (Wilmington, Del.). The ceramic-rich paste has limited blocking ability in a pack or vapor-phase process but it does not react with the part surface and it prevents sintering of the overlayed metal-rich masking paste.

Application of the dual-layer masking compounds is tedious and expensive in coating production processes. In addition, small gaps in the ceramic paste layer may result in the metal-rich paste sintering to the part, forcing the coated part to be scrapped.

A second method of masking, used primarily in vapor-phase processes, is the fabrication of metal masks which are mechanically fastened over the "no-coat" regions. Mechanical masks remove the possibility that undesirable sintering reactions (characteristic of the paste masking method) will occur. However, mechanical masks are part-specific, making them an expensive masking method where multiple part numbers and types are being coated.

Another limitation of pack and vapor-phase coating processes is an attendant heat transfer problem. Many gas turbine components, particularly those fabricated from high-strength cast nickel-base superalloys, require rapid cooling rates when processed at elevated temperatures in order to preserve alloy strength properties. Because of the large mass of pack powder required in pack processes, the necessary cooling rates can not be achieved upon completion of the coating process. This requires that the coated parts receive a second heat treatment after removal from the pack mixture, adding significant additional time and cost to the overall coating operation.

An alternative aluminization process is a vapor-phase slurry aluminization process, that incorporates a halide activator to serve as a source for producing aluminizing vapors (as in the pack aluminization process), but requires direct application of the slurry to the substrate surface. Vapor-phase slurry aluminization requires much less raw material than pack aluminization methods and further eliminates the exposure to dust particulates characteristic of the pack method. Furthermore, since each part has the necessary elements for its diffusion coating applied directly to its surface, there are no batch-size limitations as in pack or vapor-phase aluminization processes.

A limitation of vapor-phase slurry aluminization, however, like the liquid-phase slurry process, is the difficulty in producing a uniform diffused aluminide coating thickness on complex shapes such as turbine air foils. This limitation has prevented halide-activated slurry aluminization from being a viable production process like pack and vapor-phase aluminization for coating entire gas turbine components.

An example of the vapor-phase slurry aluminization process is represented by the material "PWA 545" which is utilized by the aircraft gas turbine industry for local repair of high temperature coatings. This slurry contains a halide activator powder, LiF, along with an aluminum-rich intermetallic compound ($Co_2Al_5$) which serves as a source for producing aluminizing vapors. Because of the difficulty in producing uniform diffused aluminide coatings on complex airfoil geometries with this slurry formulation, PWA 545 is not used to aluminize entire turbine blade surfaces, nor is its use permitted on turbine blade leading edges.

European published patent application 0 837 153 A2 to Olsen et al. teaches a method providing a localized aluminide coating using a pack-like mixture. A key feature of EP '153 is that the diffused aluminide coating produced with this method has an outward-type diffusion aluminide microstructure. The EP '153 method utilizes a mixture of an organic binder, a halide activator, a metallic aluminum source, and an inert ceramic material to achieve this particular coating microstructure.

The powder composition described in EP '153 is supplied to a localized region of a part in the form of a tape. The tape is applied to the part in at least one layer, however multiple layers may be employed depending upon the desired thickness of the resulting diffused aluminide. After the tape layer or layers are fixed, the part is then heated to 1800–2000° F. and held for 4 to 7 hours to produce a two-zone, low activity outwardly-diffused aluminide coating. As described in EP '153, the coating produced by this method is formed by nickel from the superalloy slowly diffusing to the surface of the part to combine with aluminum, thereby building up a coating layer of essentially pure NiAl.

Slurry aluminization coating processes are undesirably limited in their application to local regions on a turbine part and are primarily used for spot repair of a damaged pack-produced aluminide coating or vapor-phase aluminide coating. There does not exist in the current art a halide-activated aluminizing slurry formulation which produces reliably uniform diffused aluminide coatings in a uniform manner similar to pack and vapor-phase coating processes.

There is thus a need for a slurry coating composition and a coating method that can aluminize entire air-foil surfaces (regardless of geometry) in a controlled, uniform, repeatable manner thereby overcoming the current limitations of existing slurry aluminization processes. Furthermore, there is a need for a method that utilizes considerably less raw material than the pack method and that minimizes exposure to hazardous materials in the workplace. There is a need for a coating and coating process that minimizes masking requirements for areas of a substrate part that do not require coating. There is a further need for a coating or coating process method that can combine all of these features in a continuous coating process, overcoming the economic limitations of batch processes.

SUMMARY OF THE INVENTION

A slurry coating composition is provided that satisfies the aforementioned needs. A slurry coating composition is provided for the preparation of an inward-type diffusion aluminide coating, the composition of which comprises Cr—Al alloy containing from about 50 wt % Cr to about 80 wt % Cr in the alloy, LiF in an amount greater than or equal to 0.3 wt % of said Cr—Al alloy, an organic binder, and a solvent. The slurry coating composition may further comprise inert oxide materials.

A method for preparing an aluminide coating for a metal substrate is also provided. A method of the invention comprises the steps of providing a slurry coating composition which comprises Cr—Al alloy containing from about 50 wt % Cr to about 80 wt % Cr in the alloy, LiF in an amount greater than or equal to 0.3 wt % of said Cr—Al alloy, an organic binder, and a solvent. The slurry coating composition is then applied to a metal substrate and the metal substrate is then heated to form an inward-type aluminide diffusion coating. The method for preparing an aluminide coating may also comprise the step of removing unreacted residues from the metal substrate. The slurry coating composition may be applied to a metal substrate by dipping the metal substrate in the slurry coating composition. The metal substrate to which the slurry coating composition is applied is preferably a nickel-based alloy or a cobalt-based alloy.

The application of the slurry coating composition to the metal substrate and the subsequent heating of the metal substrate to form the inward-type aluminide diffusion coating may comprise a continuous process, and in particular, a one-piece-flow process.

An article of manufacture comprising a metal substrate coated with an inward-type aluminide coating is also provided. The inward-type aluminide coating is prepared in accordance with a method comprising the steps of providing a slurry coating composition which comprises Cr—Al alloy containing from about 50 wt % Cr to about 80 wt % Cr in the alloy, LiF in an amount greater than or equal to 0.3 wt % of said Cr—Al alloy, an organic binder, and a solvent. The slurry coating composition is then applied to a metal substrate and the metal substrate is then heated to form an inward-type aluminide diffusion coating. The method for preparing an aluminide coating may also comprise the step of removing unreacted residues from the metal substrate. The metal substrate to which the slurry coating composition is applied is preferably a nickel-based alloy or a cobalt-based alloy.

The article of manufacture may be coated by a method wherein application of the slurry coating composition to the metal substrate and the subsequent heating of the metal substrate to form the inward-type aluminide diffusion coating comprises a continuous process, and in particular, a one-piece-flow process.

DETAILED DESCRIPTION OF THE INVENTION

Figure 1:
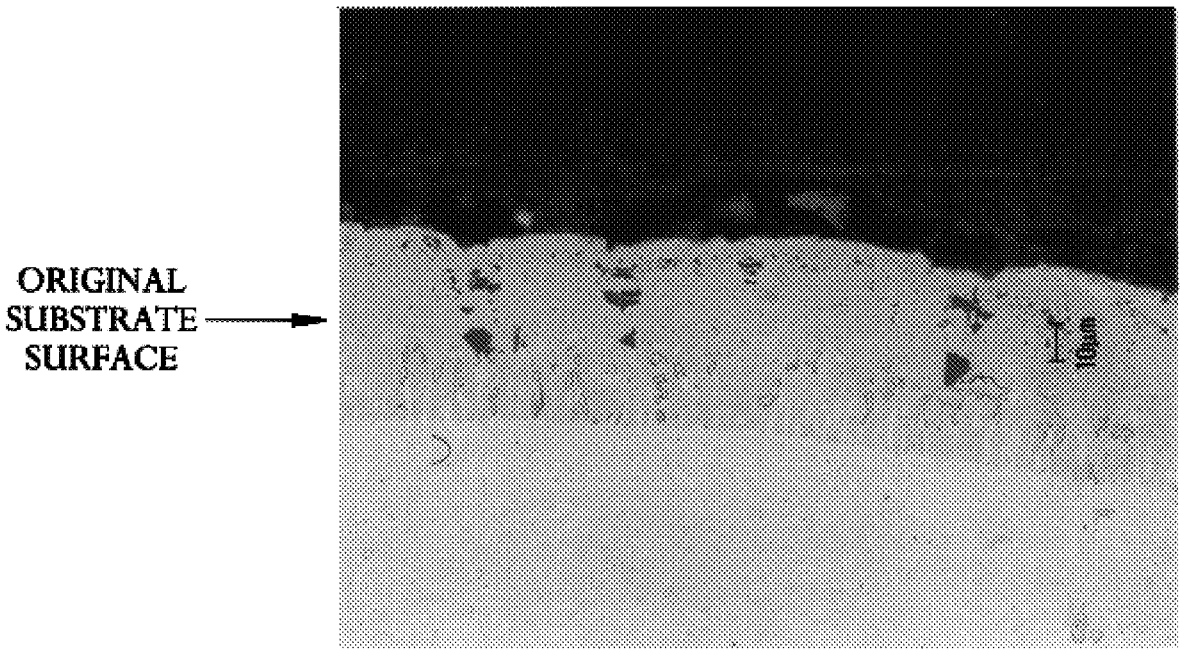
FIG. 1 is a photomicrograph (500×) showing a low activity, outwardly-diffused coating structure.
Figure 2:
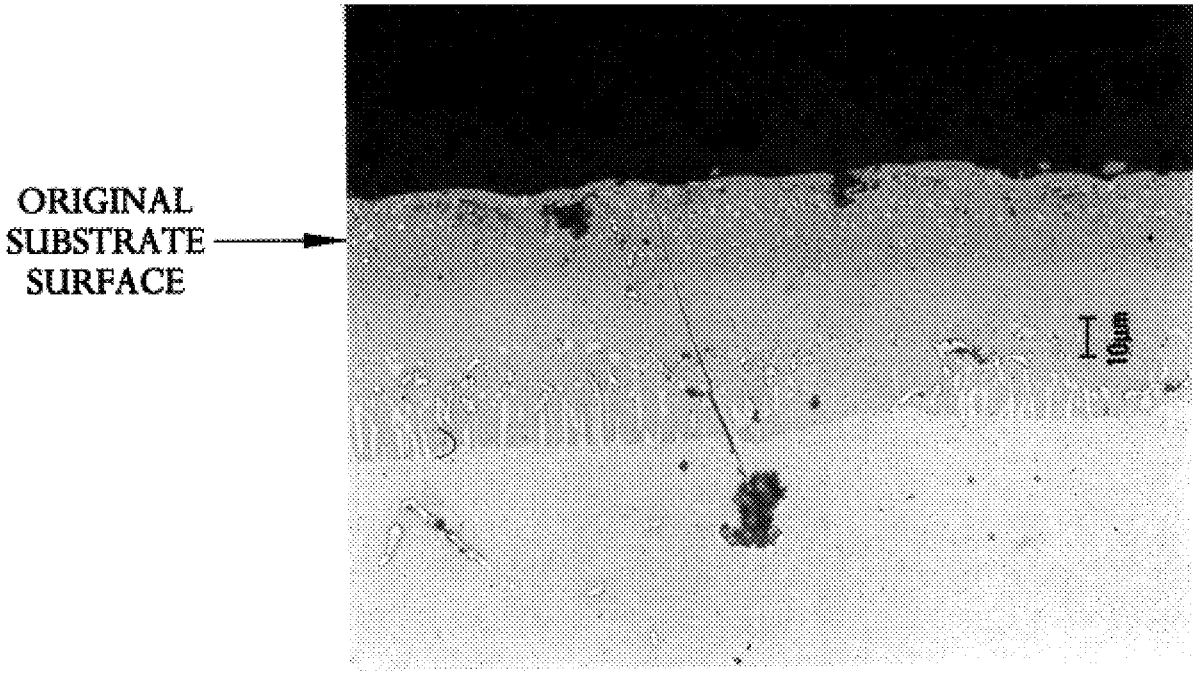
FIG. 2 is a photomicrograph (500×) showing a high activity, inwardly-diffused coating structure.

The invention relates to a class of slurry coating compositions which produce high activity, inwardly-diffused aluminide coatings having a substantially improved thickness uniformity relative to existing slurry formulations, when applied to complex geometries such as gas turbine airfoils. The slurry coating compositions of the present invention comprise a class of chromium-aluminum alloys (Cr—Al), and a specific halide activator, LiF. The Cr—Al alloys contain 50–80 weight percent chromium. The halide activator, LiF, is present in the slurry composition in an amount greater than or equal to 0.3% of the weight of the chromium—aluminum alloy. The slurry coating compositions of the present invention further include an organic binder material and a solvent.

A substantially uniform diffused aluminide coating, as understood herein, is a coating that has a calculated process capability index greater than or equal to 1.33. The process capability index, or Cp, measures the ratio of a coating thickness variance permitted by an industry specification to the natural coating thickness variation inherent in the process. An industry specification usually prescribes an upper limit and a lower limit on the coating thickness produced by a particular method. The difference between the upper and lower thickness limit is the permitted variance or allowed tolerance. For example, a Rolls-Royce specification for a pack aluminizing process (RPS 320) requires that parts have a coating thickness between 0.0005 in and 0.003 in; a Pratt & Whitney specification for a vapor-phase diffusion aluminization process (PWA 275) requires a coating thickness in the range 0.0015 in –0.003 in.

The allowable range of coating thickness variation on gas turbine hardware coated with a diffusion aluminide coating, for most industrial process specifications, is typically about 0.002 in. The natural variation of a coating thickness achieved by a particular process is usually calculated to six standard deviations ($6\sigma$). Thus, since most variances permitted by industrial specifications are narrow, the only way to improve (raise) the Cp index is to reduce the natural variation of a process. Most industrial applications require a minimum Cp of 1.33, with higher goals becoming increasingly common. For purposes herein, "substantial uniformity" is defined as $Cp \geqq 1.33$ where $Cp = 0.002\ (in)/6\sigma(in)$.

Specific alloys that have demonstrated suitable application in the slurry compositions of the invention include alloys containing, respectively, 70 wt % Cr and 56 wt % Cr (designated as 70Cr-30Al and 56Cr-44Al). Chromium—aluminum alloys having substantially more than 80 wt % Cr or substantially less than 50 wt % Cr are not viable sources for the aluminide coatings of the invention. Chromium—aluminum alloys with lower aluminum content are more likely to produce low-activity, outwardly-grown aluminide coatings. Chromium—aluminum alloys with higher aluminum contents are more likely to promote excessively high aluminum activity at the substrate surface during the diffusion coating process, compromising the uniformity of the diffused aluminide coating. These undesirable effects are avoided by maintaining the chromium content in the range 50–80 wt % of the alloy.

Suitable Cr—Al alloys are available from Reading Alloy (Robosonia, Pa.) having particle sizes –35 mesh and finer. Alloy powders having an particle size of –200 mesh and finer are employed in the coating compositions of the invention. The particle size distribution of a Cr—Al alloy appears to have no significant effect on the coating thickness uniformity achieved with slurries of the invention. The particle size selected must permit appropriate slurry viscosities to be produced, yet not inhibit or limit the reactivity of the aluminization reactions.

The amount of halide activator, LiF, present in a slurry composition of the present invention depends on the particular chromium—aluminum alloy utilized and the processing variables such as time and temperature, and the final desired coating thickness and composition. The amount of halide activator, in general, is believed to be less critical than either processing time and temperature variables to the formation of a satisfactory coating. However, LiF present in an amount below 0.3 wt % of the chromium—aluminum alloy are more likely to produce low activity, outwardly grown aluminide coatings. LiF additions above about 15 wt % Cr—Al alloy appear to confer no significant benefit to the disclosed invention. LiF is preferably present in the slurry coating composition in an amount within the range of 0.3–15 wt % Cr—Al, and most preferably in the range from about 0.6–9 wt % Cr—Al.

Slurry coating compositions of the present invention may also contain the addition of other halide activators into the slurry formulations, in addition to the LiF required of the invention. So-called "dual activator" systems are often used in pack cementation processes. In the present invention, slurry formulations containing additional halide activators, such as $AlF_3$ and $MgF_2$, have been prepared. These slurry compositions have been used to generate substantially uniform diffused aluminide coatings.

The slurry coating compositions of the invention may further contain inert oxide materials in the compositions. Inert oxides dilute aluminum's activity and therefore affect the final diffused coating's thickness and composition. The addition of aluminum oxide in the slurry composition in an amount ranging from about 4 wt % to about 60 wt % of the total slurry pigments has been observed to reduce the thickness and aluminum content of the prepared coating. However, coating thickness uniformity and the generation of an inwardly diffused coating structure has nonetheless been observed to be similar to coatings formed by slurries having no inert filler additions.

The slurry coating compositions of the present invention are prepared by dispersing solid slurry pigments (LiF, Cr—Al alloy powders, and inert oxide material if desired) in a suitable binder solution by conventional mixing or stirring. The binder solution contains an organic binder dissolved in a solvent. The selected binder must be unreactive (inert) with the Cr—Al alloy and the halide activator. The binder must not dissolve the activator. A binder should be selected to promote an adequate shelf-life for the slurry. A selected binder should also burn off cleanly and completely early in the coating process without interfering with the aluminization reactions. A suitable organic binder is hydroxypropylcellulose. A satisfactory hydroxypropylcellulose is available under the trade name Klucel™, from Aqualon Company.

The solvents employed in the slurry coating compositions of the present invention are preferably selected from the group consisting of lower alcohols, N-methylpyrrolidone (NMP), and water to produce binder solutions having a wide range of viscosities. "Lower alcohols" are understood to be $C_1$–$C_6$ alcohols. Preferred lower alcohols include ethyl alcohol and isopropyl alcohol. Other commercially available solvents are acceptable for the subject invention. The solvent's volatility, flammability, and toxicity are important commercial criteria to consider in selecting a solvent.

As noted, the amount of organic binder constituent employed in the slurry coating composition varies depending on the type of organic binder selected. In general, the amount of organic binder should be kept low to minimize interference with the aluminization process, but high enough to produce slurries with good suspension characteristics and deposition properties. For the slurry coating compositions of the invention, an organic binder level in the range of about 2 wt % to about 10 wt % of solvent should meet these requirements.

The viscosity of the slurry coating composition is also a function of the percent solid content. The solid pigments in the slurries are those constituents other than the binder and the solvent, such as LiF and the Cr—Al alloys. Preferably, a slurry coating composition of the invention has a viscosity in the range of about 250 to about 4000 cP. The quantity of solid pigments in the slurry coating composition can range from about 30 wt % to about 80 wt % of the total slurry. Slurry coating compositions formulated with a solid content in the range of about 50 wt % to about 70 wt % of the slurry are generally more readily applied to a substrate by economical methods, such as dipping or brushing. Constituents of the slurries generally settle quickly, and mixing or stirring the slurries is preferable up and until the slurry is applied.

Slurries of the present invention have demonstrated long shelf-lives in that binder material remains dissolved in the solvent and the solids content remains unreactive and stable in the binder solution.

The slurry coating compositions of the present invention may be applied to a metal substrate by conventional methods such as brushing, spraying, dipping and dip-spinning. The method of application depends on the fluid properties of the slurry composition, as well as the geometry of the substrate surface. The minimum applied slurry thickness desired for the subject formulation is approximately 0.010 inches. There is no known maximum thickness that can be applied before the uniformity of the coatings is compromised. A balance should be struck, however, to ensure complete coverage of the substrate while avoiding the waste of slurry material. If masking "no coat" regions on a part is necessary, it is understood that the appropriate application method for the slurry will be used to accommodate for the presence of the masking material.

In general, applications of approximately 0.020–0.040 inches of slurry to a metal substrate ensure adequate coverage without the use of excessive amounts of slurry composition. No specific measures or controls are required to regulate the application of the slurry since acceptable, substantially uniform diffused aluminide coatings are formed by depositing slurry in the range from about 0.010 to about 0.075 inches.

If more than one application layer is desired, it is preferable to dry the applied slurry either with warm air, in a convection oven, or under infrared lamps or the like. After the final slurry application has been made and the substrate dried, the coated parts are placed in a retort which is then purged with argon, hydrogen, or a suitable mixture thereof to achieve a dewpoint of at least −40° F. The retort is then heated to the processing temperature, maintaining adequate inert gas flow to purge all the binder outgassings and to maintain the dewpoint at the required level.

The slurry coating compositions of the invention produce substantially uniform diffused aluminide coatings when processed in the temperature range from about 1600 to about 2000° F. The thickness of the coatings produced depends upon the processing time and temperature, the particular chromium—aluminum alloy selected, and to some degree, the relative concentration of the LiF halide activator.

After processing, slurry residues are removed by wire brush, glass bead or oxide grit burnishing, high pressure water jet, or other conventional methods. Slurry residues comprise unreacted slurry composition material. The removal of slurry residue is conducted in such a way as to prevent damage to the underlying aluminide surface layer. The coated parts may be given a post-aluminizing heat treatment to further soften the coating or to complete alloy processing requirements.

The slurry coating compositions of the invention are formulated for application onto nickel-based and cobalt-based alloys. A nickel-based alloy, for example, is an alloy having a matrix phase having nickel as the proportionally largest elemental constituent (by weight). Other metals, as known in the metallurgical art, may be added to the nickel-based alloy to impart improvements in fabricability, corrosion resistance, strength, and other physical or chemical properties.

The slurry coating compositions of the invention enable a diffused aluminide coating to be produced having a substantially uniform thickness distribution, independent of applied slurry amount. Parts may be coated much more economically than present methods permit. Parts may be dipped and dried in a repeated manner until the desired slurry buildup is accomplished without serious concern about localized non-uniformity in slurry thickness on the part at edges, fillets, etc. Parts can be processed using economical single-piece-flow methods since a batch retort diffusion process is not required. During diffusion processing, the slurries of the invention form inwardly-grown aluminide coatings which are free of entrapped oxides which can form in low-activity, outwardly grown aluminide coatings.

The coatings of the present invention are illustrated by the non-limiting examples that follow. In the following examples, and unless specified otherwise, the slurries are applied to the substrates by brushing. Applied thicknesses were measured with calipers or calculated from the mass of slurry (of known specific density) applied to a known substrate surface area.

The coating thickness distribution of aluminized substrate surfaces is measured by preparing cross-sections of coated test samples. These samples were mounted using conventional hot mount compression presses and the mounted cross sections ground through a series of abrasive papers ranging from 120 to 1200 grit. Final polishing was performed, generally, for about two minutes using a colloidal silica suspension. The diffused coating thickness distribution was measured using an optical metallograph (Olympus PMG-3) and image analysis software at a magnification of 200×. Diffused coating thickness measurements were made at ten to twelve approximately equally spaced locations around the perimeter of the polished cross-sections.

Qualitative and quantitative analysis of the diffused aluminide coatings was done on a scanning electron microscope equipped with an EDS analytical spectrometer and associated quantitative analysis software.

In the preparation of the coatings of the examples, argon flow rates were generally twenty to forty volume changes per hour. Argon flow rates as low as five volume changes per hour have been effective for the subject inventions depending on the particular retort configuration used for diffusion.

EXAMPLE 1

A slurry coating composition, designated "Slurry A" was prepared in accordance with a coating of the prior art, PWA 545. A $Co_2Al_5$ alloy and LiF halide activator was used. Slurry A was prepared by mixing the following:

120 g $Co_2Al_5$ powder, −325 mesh 7.2 g LiF powder, −325 mesh 2.85 g Klucel® Type L (hydroxypropylcellulose)

37.2 g NMP solvent

A second slurry, designated "Slurry B", was prepared in accordance with the present invention by mixing the following:

120 g Cr—Al alloy powder, −200 mesh (70Cr-30Al, wt %)

7.2 g LiF powder, −325 mesh 2.85 g Klucel® Type L 37.2 g NMP solvent

Another slurry, designated "Slurry C", was prepared in accordance with the present invention by replacing the 120 g of 70Cr-30Al alloy of Slurry B with 120 g of 56Cr-44Al alloy powder, −200 mesh.

Three turbine blades cast from nickel-based superalloy MarM247 were coated, respectively, with each slurry A, B, and C. A nominal slurry thickness of about 0.010 inch to about 0.015 inch was applied.

The blades were placed in a retort which was then purged with argon gas until a −40° F. dewpoint was achieved. The retort was heated at a temperature ramp of 10° F. per minute to a set temperature of 1975° F., then held for four hours at this temperature. Argon gas flow was maintained during the heating. The retort was then cooled under argon and the blades removed from the retort.

The slurry residues were removed by glass bead burnishing. The parts were sectioned and the coating thickness distribution was measured metallographically. The coating thickness distribution results are summarized in Table 1.

TABLE 1

| Slurry | Max. Coating Thickness (0.001 in.) | Min. Coating Thickness (0.001 in.) | Range (Max.–Min.) (0.001 in.) | % Improvement Over Slurry A |
|---|---|---|---|---|
| | Coating Thickness Distribution | | | |
| A | 4.3 | 1.7 | 2.5 | — |
| B | 2.7 | 1.5 | 1.2 | 108 |
| C | 3.3 | 2.1 | 1.2 | 108 |

The slurry coating compositions prepared in accordance with the invention (Slurries B and C) produced diffusion aluminide coatings having a significantly narrower range of coating thickness variation than the slurry prepared in accordance with the prior art.

EXAMPLE 2

Three turbine blades cast from nickel-based superalloy MarM247 were coated, respectively, with the three slurry compositions (Slurries A, B and C) of Example 1. The three turbine blades had the respective slurries applied to a nominal thickness in the range from about 0.040 in. to about 0.050 in. The blades were then placed in a retort and heated as set forth in Example 1. The blades were then cooled and slurry residues were removed by glass bead burnishing. The blades were then sectioned and coating thickness distribution was measured metallographically. The coating thickness data obtained is summarized in Table 2.

TABLE 2

| Slurry | Max. Coating Thickness (0.001 in.) | Min. Coating Thickness (0.001 in.) | Range (Max.–Min.) (0.001 in.) | % Improvement Over Slurry A |
|---|---|---|---|---|
| | Coating Thickness Distribution | | | |
| A | 4.4 | 3.4 | 1.0 | — |
| B | 2.9 | 2.2 | 0.7 | 43 |
| C | 3.2 | 2.9 | 0.3 | 233 |

The slurry compositions prepared in accordance with the invention (Slurries B and C) produced coatings having a significantly narrower range of coating thickness variation than the slurry prepared according to the prior art (Slurry A).

EXAMPLE 3

Three turbine blades cast from nickel-based superalloy MarM247 were coated, respectively, with the slurry compositions of Example 1 (Slurries A, B and C) The three turbine blades had the respective slurries applied to a nominal thickness in the range from about 0.010 in. to about 0.015 in. The blades were placed in a retort which was then purged with argon gas until a −40° F. dewpoint was achieved. The retort was heated at a temperature rate of 10° F. per minute to a set point of 1875° F., then held for four hours at this temperature. Argon gas flow was maintained during the heating. The retort was then cooled under argon and the blades removed from the retort.

The slurry residues were removed by glass bead burnishing. The parts were then given a second heat treatment in a vacuum furnace for one hour at 1975° F.

After cooling, the parts were then sectioned and the coating thickness distribution was measured metallographically. The coating thickness distribution results are summarized in Table 3.

TABLE 3

| Slurry | Max. Coating Thickness (0.001 in.) | Min. Coating Thickness (0.001 in.) | Range (Max.–Min.) (0.0001 in.) | % Improvement Over Slurry A |
|---|---|---|---|---|
| | Coating Thickness Distribution | | | |
| A | 5.1 | 2.1 | 3.0 | — |
| B | 3.2 | 1.8 | 1.4 | 114 |
| C | 4.3 | 2 | 2.3 | 30 |

The slurry compositions prepared according to the present invention (Slurries B and C) produced coatings having a significantly narrower range of coating thickness variation than a coating prepared from a slurry composition (Slurry A) of the prior art.

EXAMPLE 4

Three turbine blades cast from nickel-based superalloy MarM247 were coated, respectively, with the slurry compositions of Example 1 (Slurries A, B and C). The three turbine blades had the respective slurries applied to a nominal thickness in the range from about 0.040 in. to about 0.050 in. The blades were placed in a retort which was then purged with argon gas until a −40° F. dewpoint was achieved. The retort was heated at a temperature rate of 10° F. per minute to a set point of 1875° F., then held for four hours at this temperature. Argon gas flow was maintained during the heating. The retort was then cooled under argon and the blades removed from the retort.

The slurry residues were removed by glass bead burnishing. The parts were then given a second heat treatment in a vacuum furnace for one hour at 1975° F.

After cooling, the parts were then sectioned and the coating thickness distribution was measured metallographically. The coating thickness distribution results are summarized in Table 4.

TABLE 4

| Coating Thickness Distribution | | | | |
|---|---|---|---|---|
| Slurry | Max. Coating Thickness (0.001 in.) | Min. Coating Thickness (0.001 in.) | Range (Max.–Min.) (0.0001 in.) | % Improvement Over Slurry A |
| A | 5.7 | 4.2 | 1.5 | — |
| B | 3.7 | 2.6 | 1.1 | 36 |
| C | 4.4 | 3.3 | 1.1 | 36 |

The slurry compositions prepared according to the present invention (Slurries B and C) produced coatings having a significantly narrower range of coating thickness variation than a coating prepared from a slurry composition (Slurry A) of the prior art.

EXAMPLE 5

A slurry composition (Slurry A') was prepared by mixing the following:

108 g $Co_2Al_5$ alloy powder, −325 mesh 12 g Cr powder 7.2 g LiF powder, −325 mesh 2.85 g Klucel® Type L 37.2 g NMP solvent Slurry A', a chromium-modified variation of slurry A (Example 1) was applied to a turbine blade cast from nickel-based superalloy MarM247 at a nominal thickness of about 0.040 in. to about 0.050 in. The blade was placed in a retort and heated as in Example 3, and then subjected to glass bead burnishing and another heat treatment as in Example 3. The part was then sectioned and coating thickness distribution measured metallographically. The range of coating thicknesses on this blade was in the range of about 0.0033 in. to about 0.0055 in. The range of coating thickness distribution of the aluminide coating formed using the chromium-modified slurry, about 0.0022 in, was significantly greater than that of the aluminide coatings formed from coating compositions of the invention.

EXAMPLE 6

A slurry composition, designated B', was prepared by mixing the following:

120 g 70Cr-30Al alloy powder, −200 mesh 0.72 g LiF powder, −325 mesh 2.85 g Klucel® Type L 37.2 g NMP solvent The slurry was applied to a nickel-based turbine blade by dipping the blade into the slurry mixture and drying at 300° F. in an electric air-circulating vented oven. The blade was weighed after each dip cycle until the specific gain in mass indicated that approximately 0.040 in to about 0.050 in of slurry had been applied. The blade was processed on a nickel-based turbine blade to form a coating, as in Example 2. The coating thickness distribution on the turbine blade was in the range of about 0.0023 in. to about 0.0028 in. The coating formed was an inward diffused aluminide coating with an aluminum content of approximately 34 wt %.

EXAMPLE 7

A turbine blade cast from nickel-based superalloy MarM247 was electrolytically plated with Pt at a thickness in the range from about 0.150 in. to about 0.200 in. The Pt-plated blade was then subjected to vacuum heating at 1975° F. for 15 minutes. After cooling the blades, Slurry C from Example 1 was applied to the Pt-plated blade to a thickness of about 0.040 in.

The blade was then treated as in Example 4 to form a diffused Pt-modified aluminide coating on the blade. The resulting coating was approximately 0.003–0.0035 in. thick and uniform around the entire airfoil cross-section. The aluminum content of the coating was determined to be in the range of about 27% to about 29% and the platinum content of the coating was determined to be in the range from about 35% to about 40% (by weight) This coating meets the compositional requirements of common aerospace and industrial platinum—aluminide coatings.

EXAMPLE 8

A turbine vane of cast cobalt alloy X-40 was plated with Pt, as in Example 7, at a thickness in the range from about 0.150 in. to about 0.200 in. The Pt-plated turbine vane was then subjected to vacuum heating at 1975° F. for 15 minutes. After cooling, as in Example 7, Slurry C from Example 1 was applied, as in Example 7, to the Pt-plated vane to a thickness of about 0.040 in.

The vane was then treated, as in Example 4, to form a diffused Pt-modified aluminide coating on the cobalt-containing substrate. The resulting coating was approximately 0.0015–0.002 in. thick and uniform around the entire air-foil cross-section.

EXAMPLE 9

Slurry C of Example 1 was applied to cast nickel-based superalloy turbine blades at a thickness of approximately 0.020–0.030 in.

The blades were diffused in a retort under an argon gas atmosphere at 1650° F. for 4 hours to form an inwardly-diffused aluminide coating. The blades were then cooled, then removed from the retort. The slurry residues were removed by glass bead burnishing and the blades were subsequently annealed in a vacuum furnace at 2012° F. for 1 hour.

The resultant aluminide coating on the blade was 0.0015–0.002 in. thick and uniform around the entire airfoil cross-section. The aluminum content of the coating was determined to be approximately 22 wt %. This value of aluminum content meets common specification requirements for diffused aluminide coatings.

EXAMPLE 10

A slurry composition, designated C', was prepared by mixing the following:

120 g 56Cr-44Al alloy powder, −200 mesh 6.4 g $AlF_3$ powder, −325 mesh 3.6 g LiF powder, −325 mesh 2.85 g Klucel® Type L 37.2 g NMP solvent Slurry C' was applied to nickel-based superalloy test panels at respective thicknesses of 0.020 in. and 0.050 in. The test panels were prepared and diffused in a retort at 1740° F. for 6 hours in argon atmosphere. Similar test panels were identically prepared and diffused using Slurry C of Example 1.

After diffusion, the panels were removed from the retort and the slurry residues removed by brushing. The test panels were evaluated via metallography to determine the coating thickness distribution. Metallagraphic evaluation of the coatings indicated that all the test panels had approximately equivalent diffused aluminide coatings with thickness of 0.015 to 0.0018 in. Thus, the presence of an additional halide activator had no apparent effect on the diffused aluminide coating thickness.

EXAMPLE 11

Slurry C of Example 1 was applied to a MarM247 nickel-based superalloy substrate at a thickness of about 0.020 in. The substrate was then prepared and diffused in a retort at 1875° F. for 4 hours in argon, then cooled. The slurry residues were removed by bead burnishing and the substrate then annealed in vacuum furnace at 1975° F. for 1 hour. The resultant aluminide coating had a nominal composition of 32% aluminum, 8% cobalt, 5.5% chromium, 5% tungsten, and 49.5% nickel. The observed coating structure and composition were typical of a high-activity, inwardly-diffused aluminide coating.

EXAMPLE 12

Six turbine blades cast from a nickel-based superalloy were coated, two each respectively, with slurries A and C from Example 1 and slurry A' of Example 5. The slurries were applied, by dipping, to nominal thicknesses of 0.015 in. and 0.0045 in. The blades were placed in a retort which was then purged with argon gas until a −40° F. dewpoint was achieved. The retort was heated at a rate of 10° F. per minute to a set point of 1975° F. and held for 4 hours at this temperature, maintaining the argon flow. The retort was then cooled under argon and the parts removed. The slurry residues were removed by glass bead burnishing. Coating thickness distribution was measured metallographically. Cp index ratios were calculated for the six blades. The results are summarized in Table 5.

TABLE 5

Coating Thickness Distribution

| Sample | Slurry | Applied Slurry Thickness (in.) | Mean Coating Thick-ness (in.) | Standard Deviation (in.) | Cp |
|---|---|---|---|---|---|
| 1 | A | 0.015 | 4.0 | 0.69 | 0.48 |
| 2 | A | 0.045 | 4.5 | 0.63 | 0.53 |
| 3 | C | 0.015 | 3.8 | 0.23 | 1.45 |
| 4 | C | 0.045 | 4.0 | 0.25 | 1.33 |
| 5 | A' | 0.015 | 4.3 | 0.59 | 0.56 |
| 6 | A' | 0.045 | 4.8 | 0.20 | 1.67 |

The substrate blades coated with a slurry composition of the invention, slurry C, had a significantly narrower range of coating thickness variation and significantly improved process capability relative to those parts coated with the $Co_2Al_5$-based compositions. Slurry A' showed only a marginal improvement at an applied thickness of 0.015 in. over slurry A. The mean coating thickness for the diffused coatings produced from slurry C was less sensitive to the quantity of applied slurry than either the $Co_2Al_5$-based slurry (slurry A) or the Cr-modified $Co_2Al_5$-based slurry (slurry A')

EXAMPLE 13

A slurry composition (Slurry D) was prepared by mixing the following:

120 g $Co_2Al_5$ alloy powder, −325 mesh 0.72 g LiF powder, −325 mesh 2.85 g Klucel® Type L 37.2 g NMP solvent Six each of 12 turbine blades cast from a nickel-based superalloy were coated with, respectively, Slurry D and Slurry B' of Example 6. The blades were coated by dipping to nominal applied thicknesses of about 0.015 in., 0.030 in., and 0.045 in. The parts were diffused, cleaned, sectioned, and analyzed as set forth in Example 12. The results are summarized in Table 6.

TABLE 6

Coating Thickness Distribution

| Sample | Slurry | Applied Slurry Thickness (in.) | Mean Coating Thick-ness (in.) | Standard Deviation (in.) | Cp |
|---|---|---|---|---|---|
| 1 | D | 0.015 | 2.8 | 0.52 | 0.64 |
| 2 | D | 0.015 | 2.9 | 0.44 | 0.76 |
| 3 | D | 0.030 | 3.3 | 0.46 | 0.72 |
| 4 | D | 0.030 | 3.2 | 0.33 | 1.01 |
| S | D | 0.045 | 3.1 | 0.54 | 0.62 |
| 6 | D | 0.045 | 3.1 | 0.50 | 0.67 |
| 7 | B' | 0.015 | 2.1 | 0.13 | 2.56 |
| 8 | B' | 0.015 | 2.3 | 0.13 | 2.65 |
| 9 | B' | 0.030 | 2.4 | 0.11 | 3.03 |
| 10 | B' | 0.030 | 2.3 | 0.13 | 2.56 |
| 11 | B' | 0.045 | 2.5 | 0.15 | 2.22 |
| 12 | B' | 0.045 | 2.6 | 0.12 | 2.78 |

The substrate blades coated with Slurry B', a slurry composition of the invention, exhibited a substantially uniform coating thickness. The Slurry B' coated parts had a significantly narrower range of coating thickness variation and significantly improved process capability relative to those parts coated with the $Co_2Al_5$-based formulation.

EXAMPLE 14

Turbine blade sections cut from cast nickel-based superalloys were coated with Slurry A of Example 1 (4 blade sections) and Slurry C of Example 1 (2 blade sections). Blade sections were coated to nominal thicknesses of, respectively, 0.015 in. and 0.045 in. Prior to slurry application, the trailing edge and cut surface of each blade was masked with transparent tape (Highland Invisible Tape) to prevent slurry ingress to the blade's cavities.

The blades were placed in a retort which was then purged with argon gas until −40° F. dewpoint was achieved. The retort was heated at 10° F./min to a set point of 1650° F. and held for 4 hours at this temperature, maintaining the argon flow. The retort was then cooled under argon and the parts removed. The slurry residues were removed by glass bead burnishing. The cleaned parts were then placed in a retort and annealed under dry argon at 1975° F. for 1 hours. Following heat treatment, the parts were sectioned and coating thickness distributions measured metallographically. The results are summarized in Table 7.

TABLE 7

Coating Thickness Distribution

| Sample | Slurry | Applied Slurry Thickness (in.) | Mean Coating Thick-ness (in.) | Standard Deviation (in.) | Cp |
|---|---|---|---|---|---|
| 1 | A | 0.015 | 2.1 | 0.25 | 1.33 |
| 2 | A | 0.015 | 2.0 | 0.22 | 1.52 |
| 3 | A | 0.045 | 2.0 | 0.21 | 1.59 |
| 4 | A | 0.045 | 2.2 | 0.18 | 1.85 |
| 5 | C | 0.015 | 2.0 | 0.07 | 4.76 |
| 6 | C | 0.045 | 2.0 | 0.09 | 3.70 |

The parts with coatings formed from a slurry of the invention, Slurry C, were significantly more uniform in the coating thickness distribution.

EXAMPLE 15

Two nickel-base superalloy blades were coated with approximately 0.020–0.030 in of Slurry A (Example 1).

One blade was placed in a sand-sealed retort which was then placed into an electric-fired furnace. The retort was purged with argon to a dew-point of 40° F. After the dewpoint was achieved, the argon flow was maintained and the furnace was ramped at approximately 10 ° F./min to a set point of 1650° F. and held for 4 hours. The retort was allowed to cool to about 150° F. and the blade was removed from the furnace. The slurry residues were removed by bead burnishing and the aluminide coating thickness distribution was evaluated metallographically. The coating thickness ranged from 0.0009 in to about 0.0012 in.

The second blade was placed on the hearth of a pusher-type continuous furnace with a hydrogen atmosphere. The furnace was set at 1650° F. The blade was pushed into the hot zone of the furnace by the loading ram and left for 4 hours. The part was then pushed to the unloading end of the furnace by the ram an allowed to cool. The slurry residues were removed by bead burnishing and the aluminide coating thickness distribution was evaluated metallographically. The coating thickness ranged from 0.0007 in to about 0.001 in.

The slight difference in overall diffused coating thickness between the two parts can be explained by the much faster ramp rate of the continuous pusher furnace. The uniformity and structure of the aluminide coatings on the two blades were essentially the same.

The slurry coating composition of the invention enables inward-type diffusion aluminide coatings to be formed on metal surfaces having complex geometries, with the resultant coating having a substantially uniform coating thickness distribution on the metal surface. The substantially uniform coating thickness distribution is accomplished independent of applied coating thickness. The slurry coating composition of the invention overcomes current limitations of slurry aluminization processes by enabling the formation of heat-curable inward-type diffusion aluminide coatings in a controlled, repeatable manner.

There are several economic advantages to the slurry coating composition of the invention. A method incorporating the coating composition of the invention utilizes less raw material than pack aluminization methods, which reduces hazardous waste and minimizes workplace exposure to hazardous materials. Slurry coating compositions of the invention also significantly reduce the need to mask "no coat" areas on a part's surface, as it is sufficient to merely employ a ceramic-rich masking paste only, thus eliminating the need for the additional application of a metal-rich masking paste as in common in pack and vapor-phase aluminization processes. The reduced masking requirement improves coating process economy and eliminates potential scrapping due to undesired sintering reactions with masking compounds.

The slurry coating composition of the invention enables coated parts to be cooled rapidly after completion of the coating process cycle because there is no large mass of pack powder inhibiting the cooling rate, as characteristic of the pack process. Such rapid cooling may eliminate the need for secondary heat treatment of the coated parts, depending on the alloy heat treating requirements and the coating process time and temperature.

The slurry coating composition of the invention enables a coating process method to be accomplished in a continuous fashion, overcoming the economic limitations of batch coating processes.

The present invention may be embodied in other specific forms without departing from the spirit or essential attributes thereof and, accordingly, reference should be made to the appended claims, rather than to the foregoing specification, as indicating the scope of the invention.

What is claimed:

1. A slurry coating composition for the preparation of an inward-type diffusion aluminide coating, the slurry coating composition comprising:

a. solid pigments, in the amount of from about 30% by weight to about 80% by weight of the slurry coating composition, said solid pigments comprising:
   (1) Cr—Al alloy containing from about 50 wt % Cr to about 80 wt % Cr in said alloy;
   (2) LiF in an amount from about 0.3 wt. % to about 15 wt % of said Cr—Al alloy;

b. an organic binder; and c. a solvent.

2. A slurry coating composition as in claim 1, wherein the coating composition further comprises an inert oxide, in an amount of from about 4% by weight to about 60% by weight of the solid pigments.

3. A slurry coating composition as in claim 1, wherein the organic binder is hydroxypropylcellulose.

4. A slurry coating composition as in claim 1, wherein the solvent is selected from the group consisting of lower alcohols, N-methylpyrrolidone and water.

5. A slurry coating composition as in claim 1, wherein LiF is present in the slurry in in an amount from about 0.6 wt % to about 9 wt % of the Cr—Al alloy.

6. A slurry coating composition as in claim 4, wherein the lower alcohols are selected from the group consisting of ethyl alcohol and isopropyl alcohol.

7. A slurry coating composition as in claim 2, wherein said inert oxide comprises aluminum oxide.

* * * * *